US007690179B2

(12) United States Patent
Johnson et al.

(10) Patent No.: US 7,690,179 B2
(45) Date of Patent: Apr. 6, 2010

(54) SYSTEM AND METHOD FOR MAINTAINING THE LOCATION OF A FIBER DOFF INNER-DIAMETER-TOW AT THE POINT OF PAYOUT WITHIN A CONSTANT INERTIAL REFERENCE FRAME

(75) Inventors: David W. Johnson, San Diego, CA (US); Scott A. Garrett, San Diego, CA (US); Stephen G. Moyers, Jamul, CA (US)

(73) Assignee: Ebert Composites Corporation, Chula Vista, CA (US)

( * ) Notice: Subject to any disclaimer, the term of this patent is extended or adjusted under 35 U.S.C. 154(b) by 473 days.

(21) Appl. No.: 11/771,919

(22) Filed: Jun. 29, 2007

(65) Prior Publication Data

US 2008/0314017 A1 Dec. 25, 2008

Related U.S. Application Data

(60) Provisional application No. 60/945,853, filed on Jun. 22, 2007.

(51) Int. Cl.
*D06B 23/08* (2006.01)

(52) U.S. Cl. ..... 57/1 UN; 57/91

(58) Field of Classification Search ..... 57/1 UN, 57/2.3, 90, 91; 242/550
See application file for complete search history.

(56) References Cited

U.S. PATENT DOCUMENTS 1,178,566 A * 4/1916 Wright ..... 242/128
1,333,147 A * 3/1920 Wright ..... 242/128
3,780,959 A * 12/1973 Burth ..... 242/328.2
3,806,054 A * 4/1974 Johnson et al. ..... 242/128
3,889,891 A * 6/1975 Walker ..... 242/560

(Continued)

FOREIGN PATENT DOCUMENTS

JP 2004-277064 10/2004

(Continued)

OTHER PUBLICATIONS

International Search Report and Written Opinion for related PCT/US2008/066290 dated Oct. 13, 2008.

*Primary Examiner*—Shaun R Hurley
(74) *Attorney, Agent, or Firm*—Stephen C. Beuerle; Procopio Cory Hargreaves & Savitch LLP

(57) ABSTRACT

A method of maintaining the location of a fiber doff inner-diameter-tow at a point of payout within a constant inertial reference frame includes providing a flat fiber tow payout system with a center-pull doff of flat fiber tow that pays out at a point of payout along an inner diameter of the center-pull doff with rotation of the center-pull doff about a vertically oriented axis of rotation, the flat fiber tow payout system including a constant inertial reference frame for payout of the flat fiber tow along the inner diameter of the center-pull doff without twisting the flat fiber tow; and accelerating and stopping rotation of the center-pull doff with the flat fiber tow payout system so as to maintain payout of the flat fiber tow along the inner diameter of the center-pull doff in the constant inertial reference frame, preventing twisting of the flat fiber tow.

20 Claims, 5 Drawing Sheets

U.S. PATENT DOCUMENTS 4,022,396 A * 5/1977 Manchester et al. ..... 242/160.2
4,773,610 A * 9/1988 Nordlof ..... 242/593
5,474,208 A * 12/1995 Ball ..... 221/1
6,581,257 B2 6/2003 Burton et al.
6,735,933 B2 * 5/2004 Abba et al. ..... 57/2.3
7,065,948 B2 * 6/2006 Kranich et al. ..... 57/31
2003/0121244 A1 * 7/2003 Abba et al. ..... 57/2.3

FOREIGN PATENT DOCUMENTS

KR 10-1994-0018307 8/1994
KR 10-2007-0012538 1/2007

* cited by examiner

SYSTEM AND METHOD FOR MAINTAINING THE LOCATION OF A FIBER DOFF INNER-DIAMETER-TOW AT THE POINT OF PAYOUT WITHIN A CONSTANT INERTIAL REFERENCE FRAME

CROSS-REFERENCE TO RELATED APPLICATIONS

This application claims the benefit of provisional patent application 60/945,853, filed Jun. 22, 2007 under 35 U.S.C. 119(e). This provisional patent application is incorporated by reference herein as though set forth in full.

FIELD OF THE INVENTION

The present invention relates generally to flat fiber tow payout systems and methods.

BACKGROUND OF THE INVENTION

Packages of fiber (e.g., fiberglass, carbon, aramid) are manufactured to maximize volume per unit of weight. Although fiberglass will be described herein, the principles of the invention described herein apply to other types of flat fiber tows. Glass strands produced by companies such as Owens Corning, PPG, Saint-Gobain and the like are produced by winding glass strands in a flat band. Thousands of filaments are consolidated at a discharge bushing from a glass furnace and treated, sized, consolidated, and wound on a temporary mandrel at speeds up to 1000 meters per minute or more. The wind profile places these strands in a helical fashion, creating a cylindrical tubular package called a doff. An exemplary doff may have a height of 10 inches, an outside diameter of approximately 11 inches, and an inside diameter of approximately 6.5 inches. Each doff weighs up to 40 lbs.

These doffs are then wrapped with a shrink wrap plastic on the outside and the internal temporary mandrel is removed. With the internal temporary mandrel removed, the package becomes a center-pull doff. The ultimate processor of the composite material must pull the flat strand from the center of the doff. The cylindrical tubular doffs include a vertical axis and center pull of the flat fiber tow is vertical, upwards out of the central space of the doff vacated by the temporary mandrel.

These center-pull doffs are made with different yields of glass fiber. For example, a 675-yield fiberglass strand from PPG means there will be 675 yards per pound of fiberglass. A 113 yield from Owens Corning will have 113 yards per pound of fiberglass. There are many types of yields produced. In the manufacture of these various yields, there are a myriad of helical patterns that have been developed by the manufacturers for automatic winding of the flat strands of fiber as they exit the glass furnace. A 675-yield doff from PPG has approximately 4.2 winds per helical cycle. This means that there are 4.2 turns of the manufacturer's temporary mandrel for one helical cycle of the flat strand of fiber. One helical cycle runs from the bottom of the doff to the top of the doff (or the top of the doff to the bottom of the doff). A 113 yield doff from Owens Corning has approximately 2.05 winds per helical cycle. This means that there are 2.05 turns of the manufacturer's temporary mandrel for one helical cycle of the flat strand of fiber. The wrap patterns of the doffs have been developed to optimize the size, shape, and density of the doffs.

Naturally, when one full circumferential pull-out of fiberglass ribbon is pulled from the center of the top of a doff, a 360-degree "turn" or "twist" occurs in the fiberglass ribbon.

In a 675-yield doff, there is a total distance of approximately 80,000 feet of fiberglass ribbon or tow, and about 40,000 helical wraps of the flat ribbon. This means that a fabricator pulling the tow or ribbon from the center of the doff will have 40,000 turns (or twists) of the ribbon over the entire doff.

Some types of processing (e.g., filament winding, tape laying) require that 100% of these turns (or twists) be removed as the fiber tow or ribbon is pulled out. Glass manufacturers repackage doffs onto tangent-pull spools so that downstream processing can have continuous flat ribbons; but this can cost an additional 5 cents per pound over a center-pull doff. Other processing methods (e.g., pultrusion, knitting, weaving) simply live with the flat ribbon turning in the longitudinal direction and the results of the turns/twists (e.g., an inefficient composite lay-up because of the greater thickness and bulk with a turned ribbon or tow). Maintaining tows flat and unturned is advantageous for all composite processing.

U.S. Pat. No. 6,581,257 to Burton, et al. ("Burton") attempts to achieve flat and unturned tows. In Burton, doffs are laid horizontally on their side (i.e., longitudinal axes of doffs are horizontal). The doffs are rotated using a clamped doff via an outside diameter spoked mechanism. Several doffs are integrated into a belt system such that a series of doffs are rotated at the same speed, attempting to match rotational speed to tow pull-out speed.

Burton requires the roll-up of the fiberglass onto a beam (for later and subsequent processing), which adds time and expense to the process. Burton also requires precise speed control of the beam and the doff, but does not elaborate on how the rotational speed of the doff is calculated or adjusted. The helical pattern on the wrapping of the doff creates a variable distance per revolution as well as a significant distance variation per revolution due to inside diameters changing constantly and significantly from a full doff to an empty doff. To precisely take out all 40,000 turns of a 675-yield doff by trying to match the speeds would be impossible with Burton's disclosed method. This is especially impossible when performed simultaneously with twenty five (25) doffs as shown in FIG. 2 of Burton. The length of a tow in one revolution of a 675-yield package increases by 0.0003532 inches as the 40,000 turns are removed from a 6.5 inch inside diameter at the beginning of a new doff to the 11 inch diameter at the end of the doff. Burton does not disclose how to make a speed variation in doff rotation that can accurately reflect such minute changes in length in tow length. Additionally, as the helical wind reaches the doff-top, it changes helical angle abruptly and returns in the opposite direction, resulting in a speed-discontinuity. Burton does not address this speed-discontinuity issue. Furthermore, Burton admits that the twist removal is only an average "over an extended length of yarn or strand" so Burton does not remove 100% of the twists or turns in the tow.

SUMMARY OF THE INVENTION

The system and method of the present invention takes out 100% of these turns (or twists) of fiber tow or ribbon, immediately at pay-out. Regardless of the type of doff (e.g., 675-yield, 113-yield), the system and method of the present invention takes out all the twists in the fiber tow or ribbon. It is very important that all the twists in the fiber tow or ribbon are taken out in the present invention since even one twist in 80,000 lineal feet of fiberglass can create an imperfect part, or even a scrap part. In tape laying for example, one twist could result in a hole or gap in the tape.

In the system and method of the present invention, a doff of fiberglass, as recommended by the manufacturers, rests vertically (i.e., longitudinal axis of tubular cylindrical doff is vertical), for example, on a "lazy Susan" type table that is capable of rotating in the opposite direction as the fiber pay-out. Rotation energy is imparted to the turntable by a servo (electric, DC or AC) type motor that is capable of accelerating and braking.

Looking down on a doff, if one assumes the 12:00 position is the reference point at which a flat ribbon separates from the inside diameter (ID) of the doff, then, in the present invention, the doff rotates on the turntable in a manner that allows the exit of the tow or ribbon from the ID of the doff to continually take place in approximately this 12:00 position.

Using the 12:00 position as a reference point in an inertial reference frame, as the doff turns, each part of the doff eventually turns through this 12:00 position of the reference frame. This reference location in inertial space can be defined by a band that extends approximately 15 degrees on each side of 12:00 position and varies in thickness from the ID of a new doff to the outside diameter (OD) of the doff.

The system and method ensure the exit of the ribbon or tow will be in this band. If the exit starts to go outside of the band, the turntable will be rotatably accelerated or braked, depending on which side of the band the band has been exceeded. This accelerating or braking of the turntable causes the exit of the ribbon to return within this constant band of the inertial reference frame. By controlling the system and method in this manner, 100% of the turns are taken out of the ribbon or tow independent of 1) method of pull-out, 2) speed of pull-out, 3) yield of fiber in doff, 4) number of helical turns per cycle, 5) rotational speed of the exiting ribbon, or 6) type of processing.

Where payout of multiple doffs simultaneously is required, the system and method is installed separately at a low cost on each doff being used. For example, if twenty five (25) doffs are desired, twenty five (25) separate, independent systems and method would control the payout of each doff. Unlike Burton, 25 doffs would be used independently of how full they were of strands, as each system would maintain the reference frame pay-out location, independently of doff ID. Furthermore, in a 360 degree turn of the turntable, there may be multiple acceleration and braking inputs to the motor. The purpose of the control is not to maintain speed, nor to match speeds, but alternately accelerate and brake (as many times as necessary) to discharge the flat tow from the ID of the doff at precisely the same band of the inertial reference frame. If acceleration or the braking results in an over shooting of the band, the control will either maintain acceleration or maintain braking until the band coincides with the ribbon separation from the doff ID. A sensor is used for actuation between acceleration and braking.

Another aspect of the invention involves a method of maintaining the location of a fiber doff inner-diameter-tow at a point of payout within a constant inertial reference frame. The method includes providing a flat fiber tow payout system with a center-pull doff of flat fiber tow that pays out at a point of payout along an inner diameter of the center-pull doff with rotation of the center-pull doff about a vertically oriented axis of rotation, the flat fiber tow payout system including a constant inertial reference frame for payout of the flat fiber tow along the inner diameter of the center-pull doff without twisting the flat fiber tow; and accelerating and stopping rotation of the center-pull doff with the flat fiber tow payout system so as to maintain payout of the flat fiber tow along the inner diameter of the center-pull doff in the constant inertial reference frame, preventing twisting of the flat fiber tow.

Another aspect of the invention involves a flat fiber tow payout system for maintaining the location of a fiber doff inner-diameter-tow at a point of payout within a constant inertial reference frame. The flat fiber tow payout system includes a motor; a turntable operably coupled to the servo motor and including a rotating top configured to mountably receive a center-pull doff thereto for rotation therewith about a vertically oriented axis of rotation, the center-pull doff including an inner diameter and a flat fiber tow configured to be paid out along the inner diameter of the center-pull doff; and one or more sensors configured to sense the presence and absence of the flat fiber tow after payout from the inner diameter of the center-pull doff. The flat fiber tow payout system is configured to accelerate rotation of the center-pull doff upon sensing one of the absence and presence of the flat fiber tow with the one or more sensors and stop rotation of the center-pull doff upon sensing one of the absence and presence of the flat fiber tow with the one or more sensors, whereby the location of the fiber doff inner-diameter-tow is maintained at a point of payout within a constant inertial reference frame, without twisting the flat fiber tow.

BRIEF DESCRIPTION OF DRAWINGS

The accompanying drawings, which are incorporated in and form a part of this specification, illustrate embodiments of the invention and together with the description, serve to explain the principles of this invention.

DESCRIPTION OF EMBODIMENT OF INVENTION

With reference to FIGS. 1-7, an embodiment of a flat fiber tow payout system ("system") 100 and method of using the same will be described. The system 100 withdraws a flat tow or ribbon ("tow") 110 from a center-pull doff 120. Before describing the system 100, a center-pull doff 120 will first be described.

Figure 4:
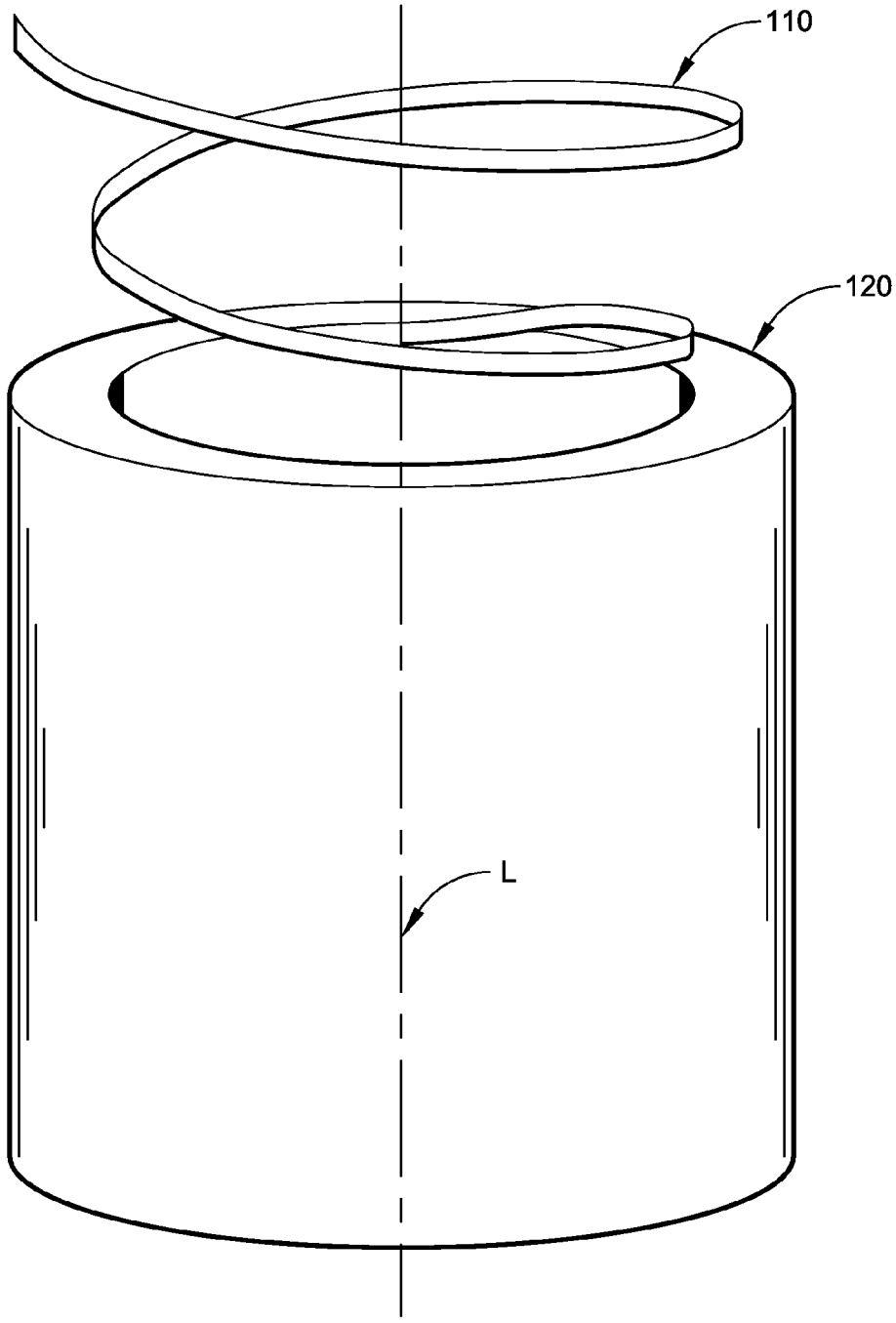
FIG. 4 is a front perspective view of a typical center-pull doff of fiberglass.

With reference to FIG. 4, as indicated above, a center-pull doff 120 is a cylindrical tubular package of helically wrapped fiber tow 110. The helically wrapped fiber tow 110 is wrapped around an internal temporary mandrel. The doff package is wrapped with a shrink wrap plastic on the outside and the internal temporary mandrel is removed. In the center-pull doff 120, the tow 110 is pulled vertical, upwards out from the central space of the doff 120 vacated by the temporary mandrel. The center-pull doff 120 includes a central longitudinal axis, axis of rotation L that is preferably vertically oriented.

Figure 5:
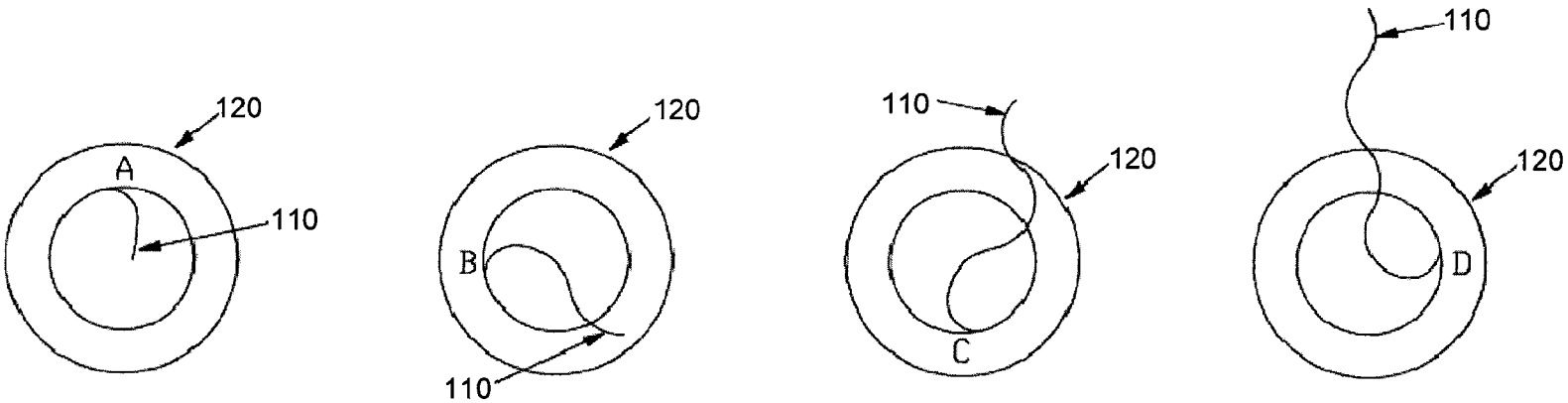
FIG. 5 is a top plan view of a center-pull doff, and shows the typical payout from a center-pull doff that is stationary.

FIG. 5 is a top plan view of a single stationary center-pull doff 120 and shows four sequential snap-shots (from left to right) of a tow 110 being removed from the center-pull doff 120. As the tow 110 is pulled upwards, out of the page, the movement of the tow pull-out location from the doff 120 from point A to point B to point C to point D and then to point A again will impart one longitudinal turn into the tow 110, also referred to herein as a twist.

As discussed above, some types of composite processing (e.g., filament winding, tape laying) require that 100% of these twists be removed as the fiber tow 110 is pulled out. The system 100 and method eliminates 100% of the twists in the tow payout during withdrawal of the tow 110 from the center-pull doff 120. Although the system 100 and method are described herein in conjunction with the withdrawal of a fiber tow 110 from center-pull doff 120 while preventing any twists in the tow 110, generally speaking, the system 100 and method maintains the location of a fiber doff inner-diameter-tow at the point of payout within a constant inertial reference frame. In alternative embodiments, the system 100 and method may be used in applications in addition to or other than preventing twists in the fiber tow during withdrawal of the fiber tow from center-pull doff.

Figure 1:
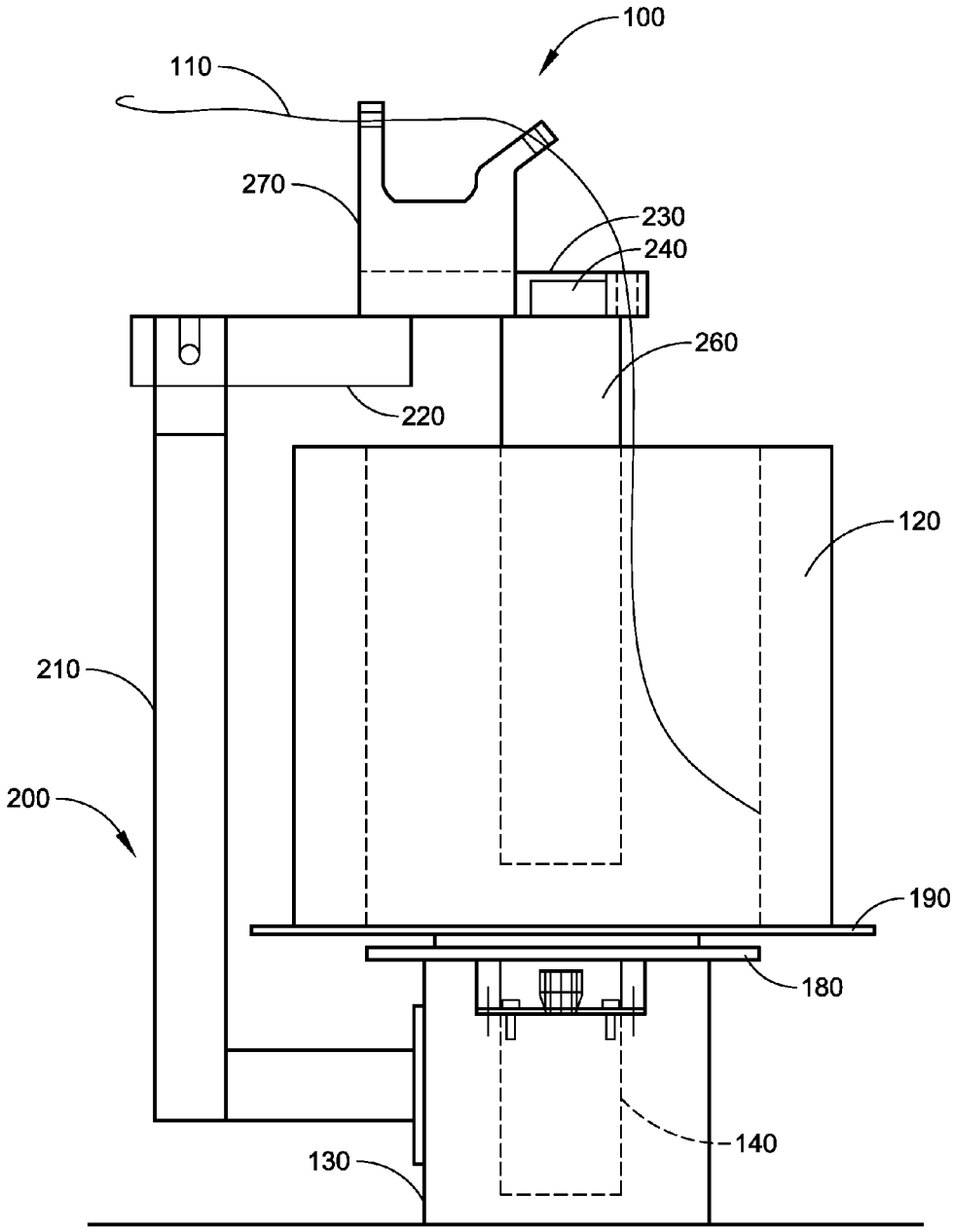
FIG. 1 is a side elevational view of an embodiment of a flat fiber tow payout system, and shows a doff on a rotating turn table, and a series of brackets holding sensing controls.
Figure 2:
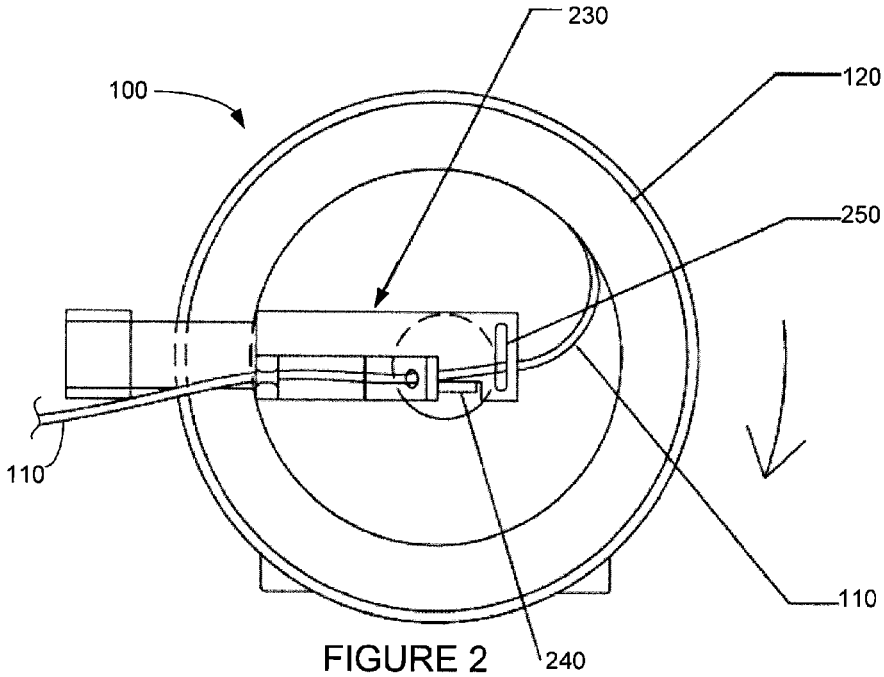
FIG. 2 is a top plan view of the flat fiber tow payout system.
Figure 3:
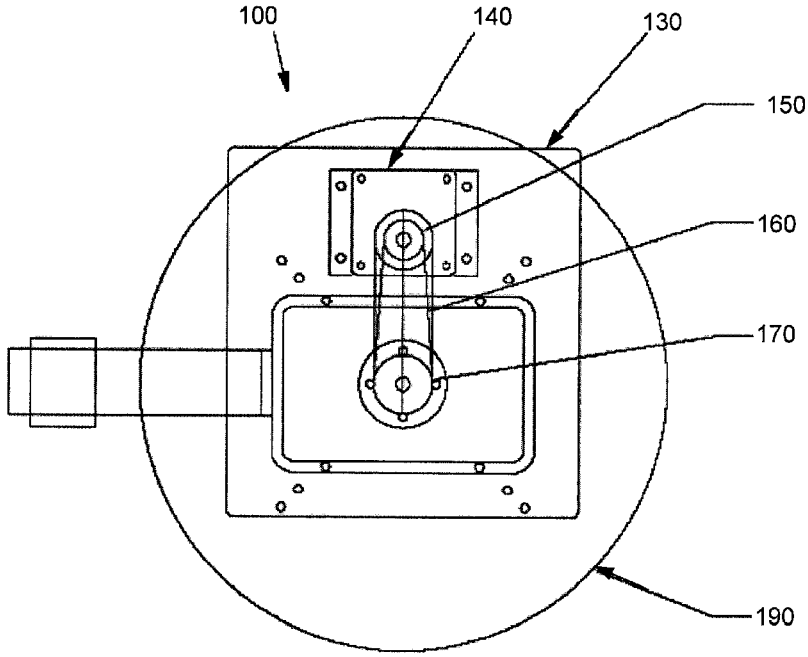
FIG. 3 is a bottom plan view of the flat fiber tow payout system.

With reference to FIGS. 1-3, the system 100 will now be described. The system 100 includes a base 130 and a servo (electric, DC or AC) type motor 140 coupled to the base 130. A sprocket 150 is connected to a shaft of the motor 140. A timing belt 160 operably couples the sprocket 150 to a turntable sprocket 170. The turntable sprocket 170 is coupled through a rotary bearing 180 to a turntable 190. The doff 120 is mounted on the turntable 190 and rotates therewith. Although the motor 140 and turntable 190 are shown as separated from each other, in an alternative embodiment, the motor 140 and turntable 190 are integrated together. For example, the turntable 190 may be directly mounted to a shaft of the motor 140.

A frame 200 extends from the base 130. The frame 200 includes a support arm or bracket 210, a removable arm or bracket 220, and a sensor bracket 230. The sensor bracket 230 carries a sensor 240. Although not shown, a controller is coupled to the sensor 240 and motor 140 for controlling the motor 140/turntable 190 in the manner described herein. As best shown in FIG. 2, the sensor bracket 230 includes a sensor slot 250. A guide mechanism 260 in the form of a guide tube is mounted to a bottom of the sensor bracket 230 and extends downwardly from the sensor bracket 230, into the center of the doff 120. A guide member 270 is mounted onto the removable bracket 220. The guide member 270 includes two upwardly extending guides with guide slots. The tow 110 extends from the doff 120 through the sensor slot 250, the guide slots of the two guides of the guide member 270, and then off to a process (e.g., pultrusion, tape laying processing, filament winding, fiber placement processing, weaving, knitting, and stitching).

With reference to FIGS. 1-3 and 6, a method of using the system 100 will now be described. During a downstream process (e.g., pultrusion, tape laying processing, filament winding, fiber placement processing, weaving, knitting, and stitching) utilizing the fiber tow 110, the tow 110 is pulled from the process at a linear speed. The tow 110 extends from the doff 120 through the sensor slot 250, the guide slots of the two guides of the guide member 270, and off to the process. As the tow 110 is utilized by the process, the process pulls the tow 110 from the system 100 to withdraw additional tow 110 from the doff 120. As the tow 110 moves through the sensor slot 250, the optical electrical sensor 240 senses the position of the tow 110 in the sensor slot 250. If the optical sensor 240 senses that the tow 110 is in the left side of the slot 250 (looking from the center of the doff 120 outward), the optical electrical sensor 240 immediately sends a signal to accelerate the motor 140. The sensor slot 250 is designed such that after an acceleration the tow 110 will have a tendency to shift to the right side of the slot 250 (looking from the center of the doff 120 outward). The optical electrical sensor 240 immediately sends a signal to brake the motor 140 once the tow 110 is at the right side and the sensor 240 sees a reflection from glass of the sensor arrangement. If the braking occurs and the table 190 keeps rotating due to inertia, the tow 110 will begin wrapping around the guide mechanism 260, and remain at the right side of the slot 250. Thus, the guide mechanism 260 prevents the tow 110 from moving over to the left side of the sensor slot 250 if the turntable 190 turns too far (e.g., by inertia). Without the guide mechanism 260, if the turntable 190 turns too far, the tow 110 would move over to the left side of the sensor slot 250, which would cause the system 100 to accidentally accelerate the turntable 190 when the turntable 190 should be stopped.

Once the payout continues and the exit point from the doff ID moves around toward the desired band (since the brake is on and the motor 140 stopped) and then beyond, the tow 110 will move off of the right side of the slot 250, and will move toward the left side of the slot 250. With the tow 110 in the left side of the slot 250, the optical electrical sensor 240 immediately sends a signal to accelerate the motor 140/table 190 until the sensor 240 detects that the tow 110 is at the right side of the slot 250, whereupon the motor 140 will immediately brake.

In one 360 degree rotation of the table 190, numerous accelerations and brakings may occur. Every 360 degree rotation of the table 190 will have a different number of and/or timing of accelerations and brakings. It is not necessary for the number of and/or timing of accelerations and brakings to be the same for each 360 degree rotation of the table 190. The objective of untwisting the tow 110 is met without requiring a speed control of any kind and the result is 100% reliability of the pay-out process with no twists. It should be noted that the maximum rotational speed is adjustable and must be high enough to accommodate the fastest feed rate of whatever process is using this system and method.

Figure 6:
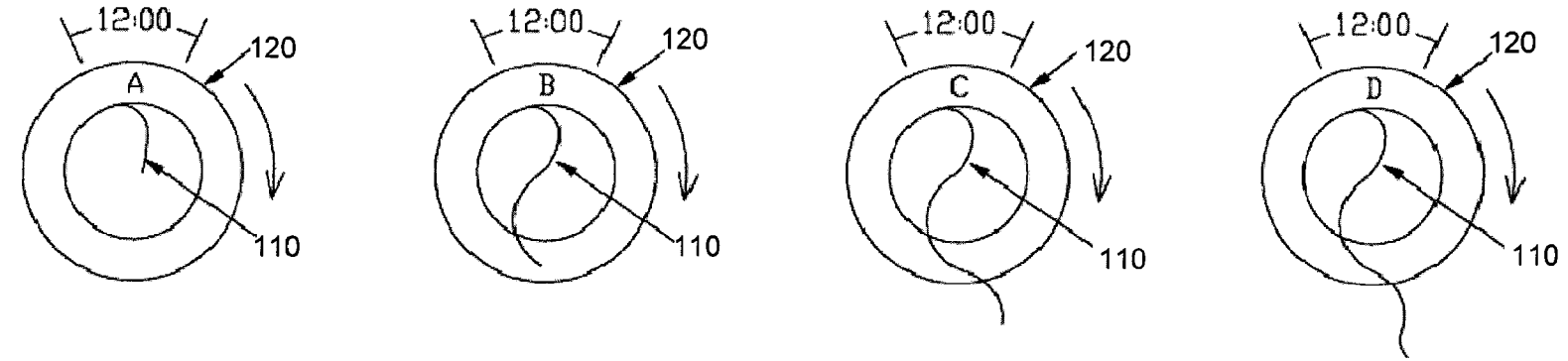
FIG. 6 is a top plan view of a center-pull doff using the flat fiber tow payout system illustrated in FIG. 1, and shows the payout of the center-pull doff and how the rotation of the doff using the flat fiber tow payout system keeps the exit point of the ribbon in one band of an inertial reference frame of the flat fiber tow payout system.

FIG. 6 shows the effect of turning the doff 120 by the system 100 as the tow 110 is pulled. The system keeps the exit of the tow 110 from the ID in the inertial arcuate band identified as 12:00. It is important to note that the flatness of the tow 110 will be maintained if positions A, B, C, and D are maintained in this 12:00 band. As mentioned above, speed or speed control is not required with the system 100 and method. Maintaining the pull out of the tow from the ID in this 12:00 band is performed independent of knowing fiber pull speeds of the downstream process, or of trying to match ever-changing rotational speeds at the ID payout location to fiber pull speeds. By providing an active control in the system 100 and method that ensures the band in inertial reference frame is maintained for the exit position of the tow 110 from the doff ID, the flat fiber tow payout system 100 and method has a 100% assurance of no twist in the ribbon 110.

Figure 7:
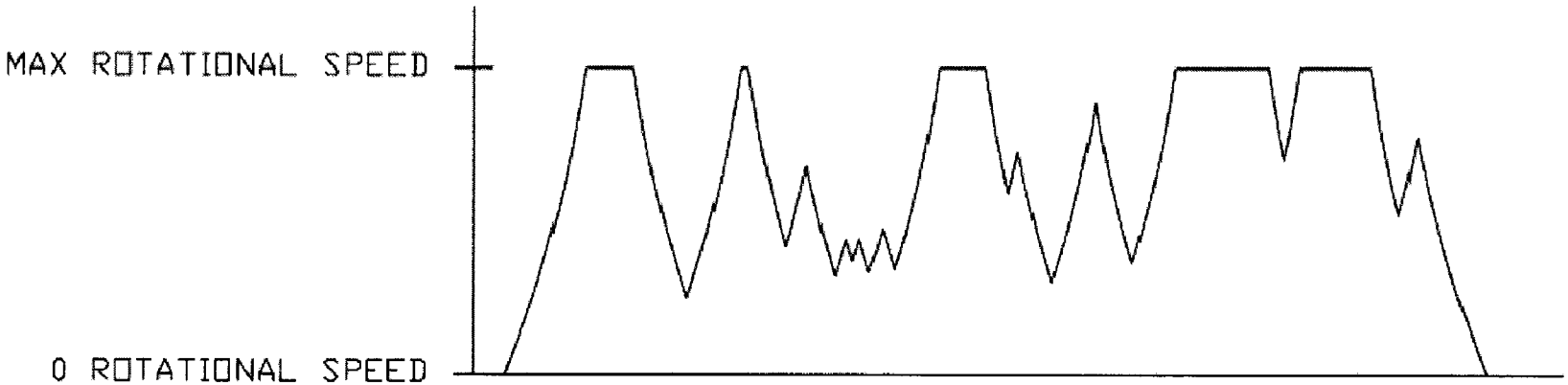
FIG. 7 is a graph that shows example acceleration and braking that may occur in the payout of 360 degrees of a fiberglass ribbon or tow using the embodiment of the flat fiber tow payout system of FIG. 1.

FIG. 7 shows the number of times the motor 140 may accelerate and brake in a one-cycle rotation (360 degree turn) of the doff 120. The acceleration and brake profile is different for each one-cycle rotation of the doff 120. In a single doff of 675-yield fiberglass, there are about 40,000 360-degree turns. Each of the 40,000 cycle-turns will have a unique profile, which is different than the profile illustrated in FIG. 7. The active control in the flat fiber tow payout system 100 and method maintain 80,000 feet of pull-off with not one twist in the ribbon or tow 110.

The flat fiber tow payout system 100 and method allows the untwisted, flat fiber ribbon 110 to be directed immediately into a downstream process such as, but not limited to, pultrusion, tape laying processing, filament winding, fiber placement processing, weaving, knitting, and stitching without requiring the roll-up of the fiberglass onto a beam (for later and subsequent processing) as in the Burton reference discussed above. In the flat fiber tow payout system 100 and method, the untwisted, flat fiber ribbon 110 can be introduced into a process with no tension (tension can then be added as required, but there is no tension exiting this process). It is desirable to handle fiberglass as little as possible so by directing the fiberglass with very low tension directly into the downstream process (compared to working the fiberglass by wrapping it around a beam like Burton), the highest integrity, highest performance fiberglass is provided with the flat fiber tow payout system 100 and method. Further, with the flat fiber tow payout system 100 and method, the speed of each downstream process does not have to be compromised since the flat fiber tow payout system and method can handle speeds from 0.001 inches per minute to 10,000 feet per minute, and even higher, automatically. If the downstream process is stopped, the flat fiber tow payout system 100 and method stops and then restarts automatically when required. This simple control can provide a wide range of flat-fiber feed rates, with no adjustments or changes required.

Although a single system 100 has been described herein to assist the reader in understanding the invention, in another embodiment, multiple systems 100 are used to withdraw fiber tow 110 from multiple respective center-pull doffs 120 while preventing any twists in the tow 110. From the systems 100, the untwisted tows 110 are directed immediately into a downstream process such as, but not limited to, pultrusion, tape laying processing, filament winding, fiber placement processing, weaving, knitting, and stitching without requiring the roll-up of the fiberglass onto a beam or beams (for later and subsequent processing) as in the Burton reference discussed above.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art.

What is claimed is:

1. A method of maintaining the location of a fiber doff inner-diameter-tow at a point of payout within a constant inertial reference frame, comprising:

providing a flat fiber tow payout system with a center-pull doff of flat fiber tow that pays out at a point of payout along an inner diameter of the center-pull doff with rotation of the center-pull doff about a vertically oriented axis of rotation, the flat fiber tow payout system including a constant inertial reference frame for payout of the flat fiber tow along the inner diameter of the center-pull doff without twisting the flat fiber tow;

accelerating and stopping rotation of the center-pull doff with the flat fiber tow payout system so as to maintain payout of the flat fiber tow along the inner diameter of the center-pull doff in the constant inertial reference frame, preventing twisting of the flat fiber tow.

2. The method of claim 1, wherein the flat fiber tow payout system includes one or more sensors that sense the presence and absence of the flat fiber tow after payout from the inner diameter of the center-pull doff, and the flat fiber tow payout system accelerating rotation of the center-pull doff upon sensing one of the absence and presence of the flat fiber tow with the one or more sensors and stopping rotation of the center-pull doff upon sensing one of the absence and presence of the flat fiber tow with the one or more sensors.

3. The method of claim 2, wherein the flat fiber tow payout system includes a single sensor, and the flat fiber tow payout system accelerates rotation of the center-pull doff upon sensing the presence of the flat fiber tow with the sensor and stops rotation of the center-pull doff upon sensing the absence of the flat fiber tow with the sensor.

4. The method of claim 2, wherein the flat fiber tow payout system includes a guide mechanism that extends downwardly into a center of the center-pull doff, and the method further including the flat fiber tow at least partially wrapping around the guide mechanism so that the guide mechanism maintains the flat fiber tow in position relative to the one or more sensors so that the one or more sensors send a signal causing the flat fiber tow payout system to stop rotation of the center-pull doff, to prevent accidental acceleration of the center-pull doff.

5. The method of claim 1, wherein the flat fiber tow payout system includes a servo motor, a turntable operably coupled to the servo motor and including a rotating top, and the center-pull doff is mounted to the rotating top of the turntable for rotation therewith about the vertically oriented axis of rotation.

6. The method of claim 1, further including a downstream process drawing the untwisted flat fiber tow at varying linear speeds, and the flat fiber tow payout system accelerating and stopping rotation of the center-pull doff so as to maintain payout of the flat fiber tow along the inner diameter of the center-pull doff in the constant inertial reference frame and supply untwisted flat fiber tow directly to the downstream process at the varying linear speeds.

7. The method of claim 1, further including a downstream process drawing the untwisted flat fiber tow at a constant linear speed, and the flat fiber tow payout system accelerating and stopping rotation of the center-pull doff so as to maintain payout of the flat fiber tow along the inner diameter of the center-pull doff in the constant inertial reference frame and supply untwisted flat fiber tow directly to the downstream process at the constant linear speed.

8. The method of claim 1, wherein accelerating and stopping of the center-pull doff includes accelerating and braking rotation of the center-pull doff about the vertically oriented axis of rotation through multiple 360-degree rotations, and each 360-degree rotation having a different acceleration and braking profile.

9. The method of claim 1, further including a downstream process drawing the untwisted flat fiber tow at a linear speed, and the flat fiber tow payout system accelerating and stopping rotation of the center-pull doff so as to maintain payout of the flat fiber tow along the inner diameter of the center-pull doff in the constant inertial reference frame and supply untwisted flat fiber tow directly to the downstream process at the linear speed without speed control of the flat fiber tow payout system.

10. The method of claim 1, wherein providing a constant inertial reference frame includes providing an inertial arcuate band as the constant inertial reference frame, and accelerating and stopping rotation of the center-pull doff so as to maintain payout of the flat fiber tow along the inner diameter of the center-pull doff in the inertial arcuate band, preventing twisting of the flat fiber tow.

11. The method of claim 1, wherein the flat fiber tow paid out by the flat fiber tow payout system is not in tension.

12. The method of claim 1, wherein the flat fiber tow payout system includes multiple flat fiber tow payout systems with respective center-pull doffs, and the multiple flat fiber tow payout systems maintain the location of fiber doff inner-diameter-tows at a point of payout within a constant inertial reference frame so as to prevent twisting of the flat fiber tows, and using the multiple flat fiber tow payout systems to immediately direct the untwisted flat fiber tows to a downstream process including one of pultrusion, tape laying processing, filament winding, fiber placement processing, weaving, knitting, and stitching.

13. A flat fiber tow payout system for maintaining the location of a fiber doff inner-diameter-tow at a point of payout within a constant inertial reference frame, comprising:

a motor;

a turntable operably coupled to the servo motor and including a rotating top configured to mountably receive a center-pull doff thereto for rotation therewith about a vertically oriented axis of rotation, the center-pull doff including an inner diameter and a flat fiber tow configured to be paid out along the inner diameter of the center-pull doff; and one or more sensors configured to sense the presence and absence of the flat fiber tow after payout from the inner diameter of the center-pull doff, wherein the flat fiber tow payout system is configured to accelerate rotation of the center-pull doff upon sensing one of the absence and presence of the flat fiber tow with the one or more sensors and stop rotation of the center-pull doff upon sensing one of the absence and presence of the flat fiber tow with the one or more sensors, whereby the location of the fiber doff inner-diameter-tow is maintained at a point of payout within a constant inertial reference frame, without twisting the flat fiber tow.

14. The system of claim 13, wherein the flat fiber tow payout system includes a single sensor, and the flat fiber tow payout system accelerates rotation of the center-pull doff upon sensing the presence of the flat fiber tow with the sensor and stops rotation of the center-pull doff upon sensing the absence of the flat fiber tow with the sensor.

15. The system of claim 13, wherein the flat fiber tow payout system includes a guide mechanism configured to extend downwardly into a center of the center-pull doff and maintain the flat fiber tow in position relative to the one or more sensors so that the one or more sensors send a signal causing the flat fiber tow payout system to stop rotation of the center-pull doff, to prevent accidental acceleration of the center-pull doff.

16. The system of claim 13, wherein the flat fiber tow payout system is configured to be used with a downstream process that draws the untwisted flat fiber tow at one of varying linear speeds and a constant speed, and the flat fiber tow payout system is configured to accelerate and stop rotation of center-pull doff independent of the linear speed of the untwisted flat fiber tow drawn by the downstream process.

17. The system of claim 13, wherein the flat fiber tow payout system is configured to accelerate and brake rotation of the center-pull doff through multiple 360-degree rotations, and each 360-degree rotation includes a different acceleration and braking profile.

18. The system of claim 13, wherein the constant inertial reference frame is an inertial arcuate band.

19. The system of claim 13, wherein the flat fiber tow payout system is configured to pay out the flat fiber tow so that the flat fiber tow is not in tension.

20. The system of claim 13, wherein the flat fiber tow payout system includes multiple flat fiber tow payout systems with respective center-pull doffs, and the multiple flat fiber tow payout systems are configured to maintain the location of fiber doff inner-diameter-tows at a point of payout within a constant inertial reference frame so as to prevent twisting of the flat fiber tows, and the multiple flat fiber tow payout systems are configured to immediately direct the untwisted flat fiber tows to a downstream process including one of pultrusion, tape laying processing, filament winding, fiber placement processing, weaving, knitting, and stitching.

* * * * *